US007497250B2

(12) United States Patent
Coy et al.

(10) Patent No.: US 7,497,250 B2
(45) Date of Patent: Mar. 3, 2009

(54) TRIANGULAR SHAPED HEAT EXCHANGER

(75) Inventors: Randall L. Coy, Tulsa, OK (US); Joe E. Sumter, Jr., Claremore, OK (US)

(73) Assignee: Tri-X-Flo, L.L.C., Claremore, OK (US)

( * ) Notice: Subject to any disclaimer, the term of this patent is extended or adjusted under 35 U.S.C. 154(b) by 314 days.

(21) Appl. No.: 11/360,365

(22) Filed: Feb. 23, 2006

(65) Prior Publication Data

US 2007/0193725 A1 Aug. 23, 2007

(51) Int. Cl.
*F24H 3/06* (2006.01)
*F28F 13/12* (2006.01)

(52) U.S. Cl. ..... 165/122; 165/124; 165/126; D23/323; D23/314

(58) Field of Classification Search ..... 165/122, 165/124, 126; D23/323, 314
See application file for complete search history.

(56) References Cited

U.S. PATENT DOCUMENTS

D210,725 S * 4/1968 Turco ..... D23/351
3,472,042 A * 10/1969 Shriver et al. ..... 62/305
3,716,097 A * 2/1973 Kelp et al. ..... 165/299
3,921,603 A * 11/1975 Bentz et al. ..... 123/41.33
4,657,070 A * 4/1987 Kluppel ..... 165/124
D303,285 S * 9/1989 Mongeau ..... D23/314
5,947,195 A * 9/1999 Sasaki ..... 165/173
6,474,272 B2 * 11/2002 Bensing et al. ..... 122/459
D483,454 S 12/2003 Coy et al.

* cited by examiner

*Primary Examiner*—Cheryl J Tyler
*Assistant Examiner*—Brandon M Rosati
(74) *Attorney, Agent, or Firm*—Molly D. McKay

(57) ABSTRACT

A more efficient heat exchanger with walls of heat exchanger coils oriented at compound angles with respect to its associated heat exchanger fan. The bottom edge of each heat exchanger coil wall is oriented at an angle of between approximately 35 and 85 degrees to the fan, and each heat exchanger coil is tilted inward at an angle of between approximately 35 and 85 degrees relative to a plane connecting the two bottom edges of the heat exchanger coil wall. One or multiple coils can be provided in each heat exchanger coil wall and an optional top heat exchanger coil can be added to the top of the heat exchanger. The front of the heat exchanger, which is normally pointed for forced draft units, is replaced with a triangular shaped plate and a modified trapezoidal shaped base for induced draft units.

2 Claims, 7 Drawing Sheets

TRIANGULAR SHAPED HEAT EXCHANGER

BACKGROUND OF THE INVENTION

1. Field of the Invention

The present invention relates to a heat exchanger with a unique orientation of the heat exchanger coils relative to the heat exchanger fan. Specifically the heat exchanger coils of the present invention are oriented so that each heat exchanger coil makes double or compound angles with respect to the plane in which the heat exchanger fan is located. By orienting the coils in this manner relative to the fan, this triangular shaped heat exchanger operates more efficiently than conventional box type heat exchangers.

2. Description of the Related Art

Conventional box type heat exchangers have the heat exchanger coils located in a plane that is perpendicular to a plane in which the fan operates. This orientation is inefficient for several reasons. Air exiting the heat exchanger fan does not flow directly outward at a 90 degree angle from the fan, but instead exits the fan at an angle of approximately 30 degrees. Thus, the air of conventional box type heat exchangers impinges on the heat exchanger coils at approximately a 60 degree angle instead of perpendicularly. This 60 degree angle of impingement has several adverse effects.

First, because the air is impinging on the coil at an angle, the amount of air that passes directly through the coil is reduced, thereby reducing the efficiency of the heat exchanger. The air that does not pass through the coil bounces back into the plenum area of the conventional heat exchanger. This bounced back air causes turbulence and noise. It also causes back pressure on the fan which further decreases the efficiency of the heat exchanger since the fan must now work harder to overcome the increased backpressure within the plenum area of the heat exchanger. Because the fan is working harder against the increased back pressure within the plenum, the operating life of the fan will be shortened.

Additionally, because a reduced amount of air travels through the coil, the discharge air velocity coming from the coil is lower and the hot discharge air can more easily be pulled back into the intake of the fan. This recirculation of hot discharge air through the heat exchanger further decreases the operation efficiency of the conventional box type heat exchanger.

Still another problem with conventional box type heat exchangers is that they do not produce good air flow coverage in the center of the coils or in the corners of the coils. The poor air coverage of these units results in a decrease in the life of their coils and in their associated compressors.

The present invention addresses these problems by providing a triangular shape heat exchanger that has its coils oriented in double or compound angles relative to the plane in which the fan operates. This orientation of the coils allows air from the fan to strike the coils at an angle that is approximately perpendicularly, i.e. the air strikes the coils so that the angle of impact is approximately 90 degrees. This perpendicular angle of impact or impingent has several advantages that increase the efficiency of the present invention.

First, because the air is impinging on the coil perpendicularly, an increased amount of air passes directly through the coil, thereby increasing the efficiency of the present invention. Only a small amount of air will not pass through the coils of the present invention and that air is bounced to the front end of the plenum area where, because of the unique shape of the front end, the air is deflected downward and not back toward the fan. This results in less turbulence, less noise and less static pressure. This translates into a unit that operates more quietly than conventional box type heat exchangers.

Another factor contributing to the quiet operation of the present invention is that less material or metal is employed in building the present invention than is used in conventional box type heat exchangers. By using less metal in its construction, the present invention is less expensive to manufacture. Also, with less metal to vibrate, the present invention operates more quietly.

The present invention produces little back pressure on the fan which further increases the efficiency of the invention since the fan does not have to work harder to overcome an increased backpressure within the plenum area of the heat exchanger. This allows the fan size to be decreased over the size that would normally be required in conventional box type units. This also allows for a higher speed fan to be employed in the present invention. And, less back pressure results in increased fan operating life.

Additionally, because a larger amount of air travels through the coil, the discharge air velocity coming from the coil of the present invention is higher and the hot air is therefore less easily pulled back into the intake of the fan. This eliminates or greatly reduces the recirculation of hot discharge air through the heat exchanger and further increases the operation efficiency of the present invention.

The design of the present invention produces approximately 90% air coverage of the coils whereas conventional box type heat exchangers achieve only about 60% air coverage of the coils. This increase in air coverage results in an increase in the life of the coils and associated compressors. Also, smaller compressors are needed in association with the present invention, resulting in manufacturing cost savings over conventional box type heat exchanger installations.

A further advantage of the present invention is that the present invention has a smaller footprint and therefore takes up less room than conventional box type heat exchangers. This makes the present invention suitable for installations where space is limited.

A still further advantage is that the present invention can be designed to accommodate multiple service heat exchanger coils, thereby allowing a single heat exchanger to serve several different applications. This versatility decreases the number of heat-exchangers required for a facility, resulting in installation and operational savings.

SUMMARY OF THE INVENTION

The present invention is a heat exchanger having two walls of heat exchanger coils oriented at double or compound angles with respect to a plane in which its associated heat exchanger fan is located. The bottom edge of each heat exchanger coil wall is oriented at an angle of approximately 60 degrees to the plane in which the fan operates, and each heat exchanger coil is tilted inward at an angle of approximately 60 degrees relative to a plane connecting the two bottom edges of the heat exchanger coil wall. Each of these angles can be varied by approximately 25 degrees, although it is believed that 60 degrees is the optimum orientation for each of these two angles. Thus, the bottom edge of each heat exchanger coil wall can be oriented at an angle of between approximately 35 and 85 degrees to the plane in which the fan operates, and each heat exchanger coil is tilted inward at an angle of between approximately 35 and 85 degrees relative to a plane connecting the two bottom edges of the heat exchanger coil wall. By orienting the coils in this manner relative to the fan, this triangular shaped heat exchanger operates more efficiently than conventional box type heat exchangers.

Each heat exchanger coil wall can be provided with one or with multiple coils that can provide heat exchange capability to a variety of applications. Also, an optional top heat exchanger coil can be added to the top of the heat exchanger to provide added heat exchange capacity.

The front or nose of the heat exchanger normally forms a pointed and downwardly sloping end where the two sloping front edges of the heat exchanger coil walls meet at the front of the heat exchanger. This front edge extends downward and secures to the front point of the triangular shaped base of the heat exchanger. This arrangement works well for forced draft heat exchangers where the heat exchanger fan is pushing air through the plenum and then out of the heat exchanger through the coils. However, on induced draft heat exchangers where the heat exchanger fan is pulling air through the coil, then through the plenum and finally out of the heat exchanger through the fan, the front end of the heat exchanger does not need to be pointed. For those induced draft units, the heat exchanger coil wall can be terminated at the front edge of the heat exchanger coils and a triangular shaped plate can be used to secure together the front edges of the shortened heat exchanger coil walls and the front edge of a modified base of the heat exchanger. The modified base of the induced draft unit would be trapezoidal shaped.

DETAILED DESCRIPTION OF THE PREFERRED EMBODIMENT

The Invention

Figure 1:
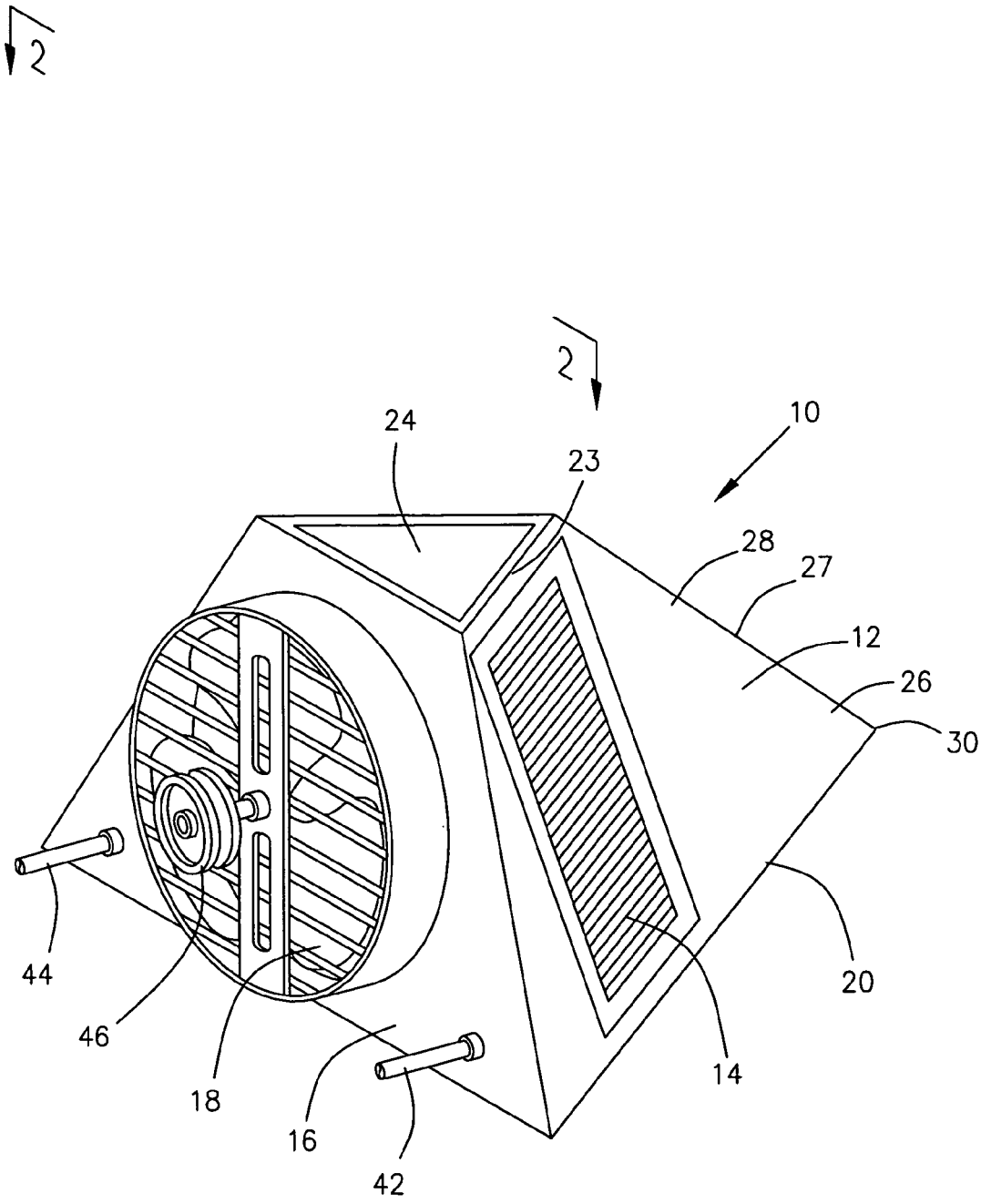
FIG. 1 is a perspective view of a triangular shaped heat exchanger constructed in accordance with a preferred embodiment of the present invention.
Figure 2:
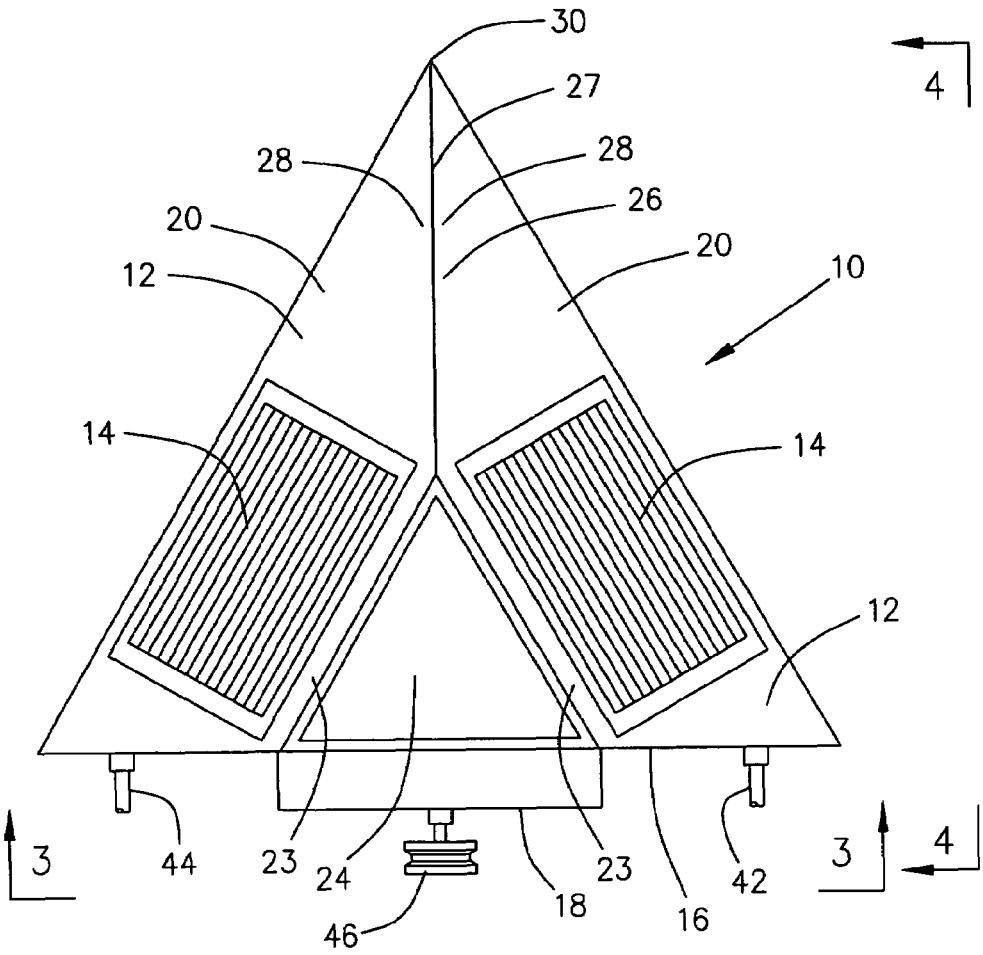
FIG. 2 is a top plan of the preferred embodiment taken along line 2-2 of FIG. 1.

Referring now to the Figures and initially to FIGS. 1-6, there is illustrated a triangular shaped heat exchanger 10 constructed in accordance with a preferred embodiment of the present invention. The heat exchanger 10 shown in these figures has two heat exchanger walls 12 containing heat exchanger coils 14, with the walls 12 oriented at double or compound angles, angles A and B, with respect to a plane 16 in which its associated heat exchanger fan 18 is located. The plane 16 in which the heat exchanger fan 18 is located is represented in the drawings by the rear wall 16 of the heat exchanger 10 on which the fan 18 is mounted to the heat exchanger 10.

A bottom edge 20 of each heat exchanger coil wall 12 is secured to a triangular shaped base 22 and a top edge 23 of each heat exchanger coil wall 12 is secured to a triangular shaped top 24. Together the rear wall 16 and its associated fan 18, the base 22, the top 24, and the two walls 12 cooperate to define an internal space or plenum area for the triangular heat exchanger 10.

Figure 3:
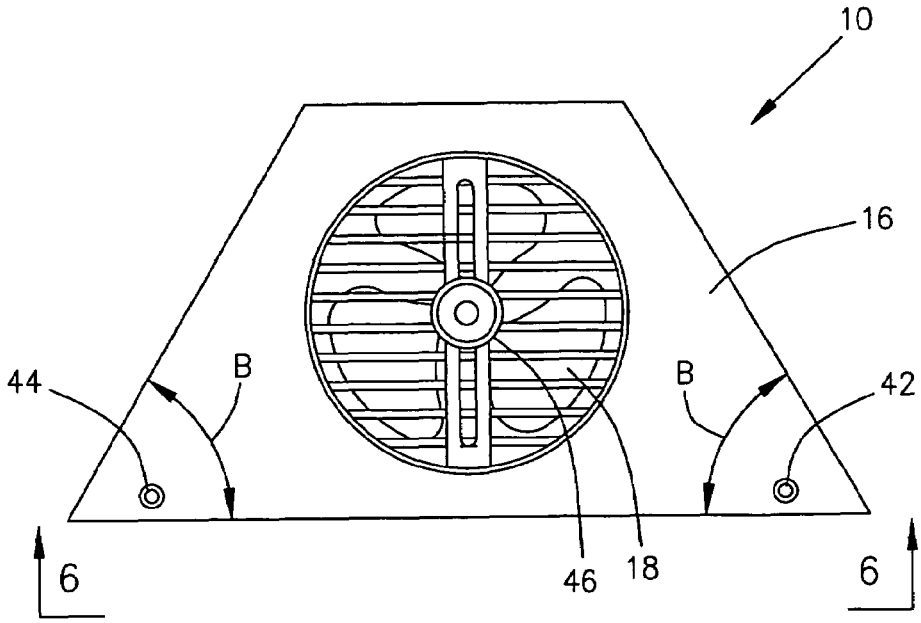
FIG. 3 is a rear view of the preferred embodiment taken along line 3-3 of FIG. 2.
Figure 6:
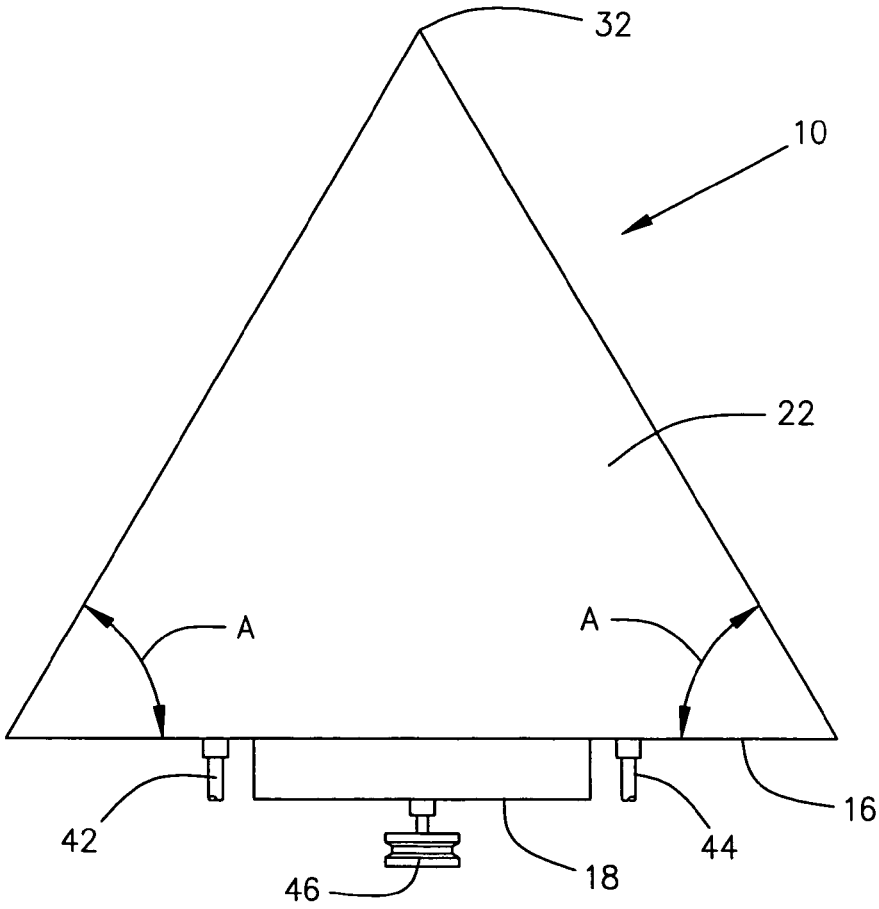
FIG. 6 is a bottom plan view of the preferred embodiment taken along line 6-6 of FIG. 3.

Each heat exchanger coil wall 12 is preferably oriented at an angle A of approximately 60 degrees to the plane 16 in which the fan 18 operates. Angle A is illustrated in FIG. 6. Also, each heat exchanger coil wall 12 is preferably tilted inward toward its associated opposite heat exchanger coil wall 12 at an angle B of approximately 60 degrees relative to a second plane 22 connecting the two bottom edges 20 of the heat exchanger coil walls 12. Angle B is illustrated in FIG. 3. The second plane 22 that connects the two bottom edges 20 of the heat exchanger coil walls 12 is represented in the drawings by the base 22 of the heat exchanger 10. Although it is believed that 60 degrees is the optimum orientation both angle A and angle B, each of these angles can be varied by approximately + or −25 degrees. Thus, the bottom edge 20 of each heat exchanger coil wall 12 can be oriented at an angle A of between approximately 35 and 85 degrees to the plane 16 in which the fan 18 operates, and each heat exchanger coil wall 12 is tilted inward at an angle B of between approximately 35 and 85 degrees relative to a second plane 22 connecting the two bottom edges 20 of the heat exchanger coil walls 12. By orienting the coils 14 in this manner relative to the fan 18, this triangular shaped heat exchanger 10 operates more efficiently than conventional box type heat exchangers.

Figure 2A:
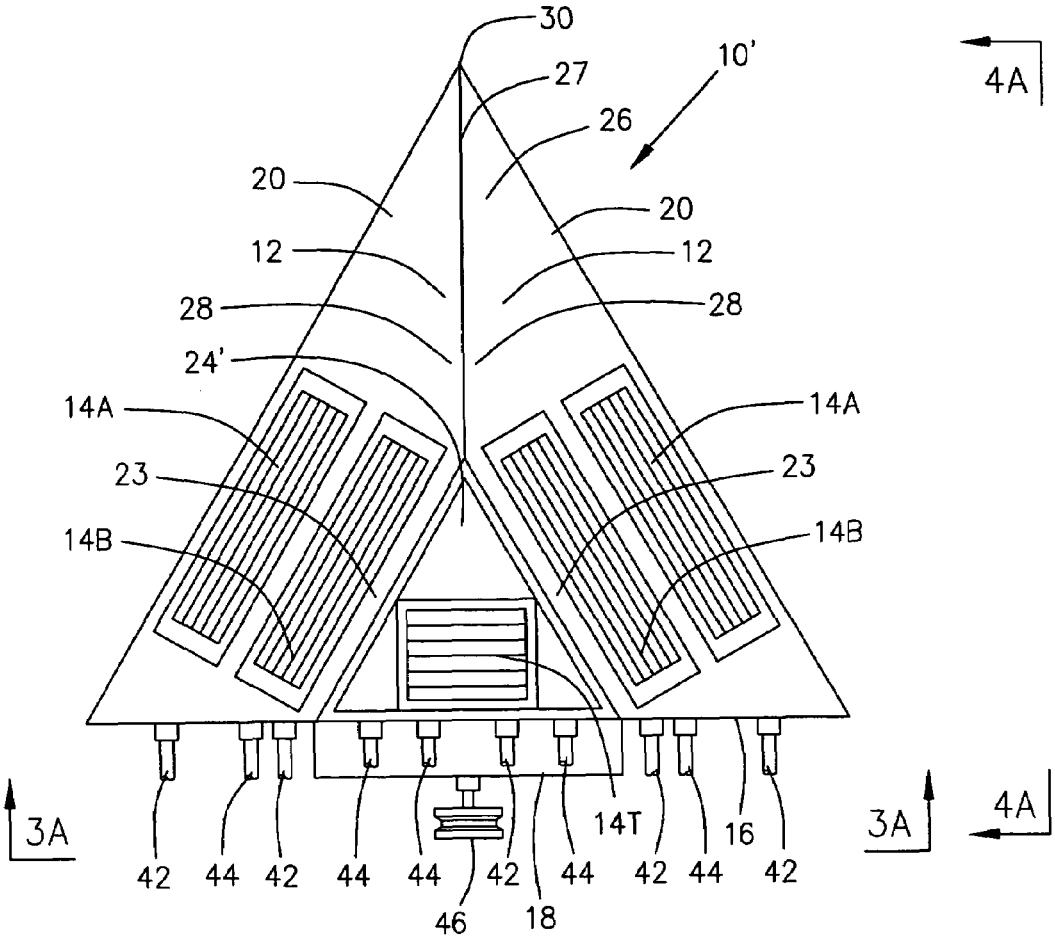
FIG. 2A is a top plan view of a first alternate embodiment of the present invention showing multiple coils on each wall of the heat exchanger and showing an optional top heat exchanger coil.
Figure 3A:
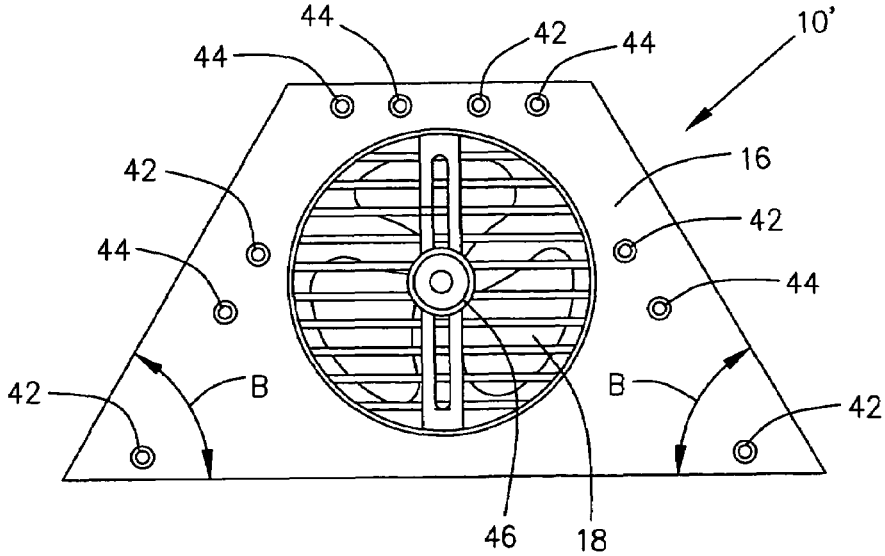
FIG. 3A is a rear view of the first alternate embodiment taken along line 3A-3A of FIG. 2A.
Figure 4:
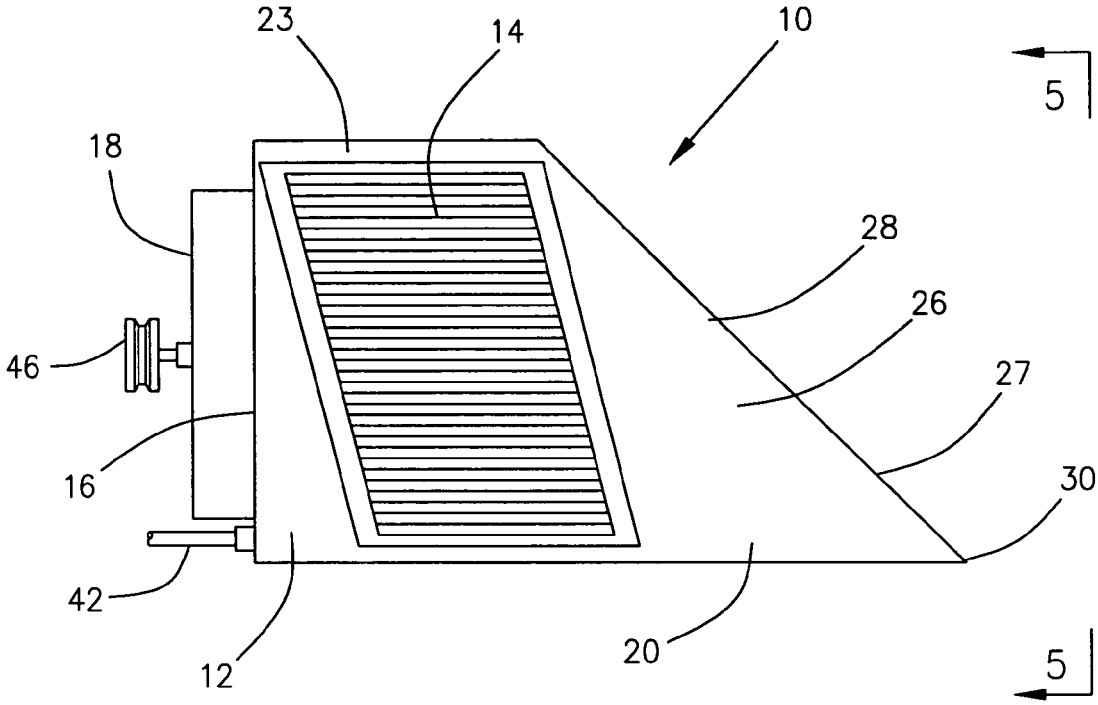
FIG. 4 is a right side view of the preferred embodiment taken along line 4-4 of FIG. 2.
Figure 5:
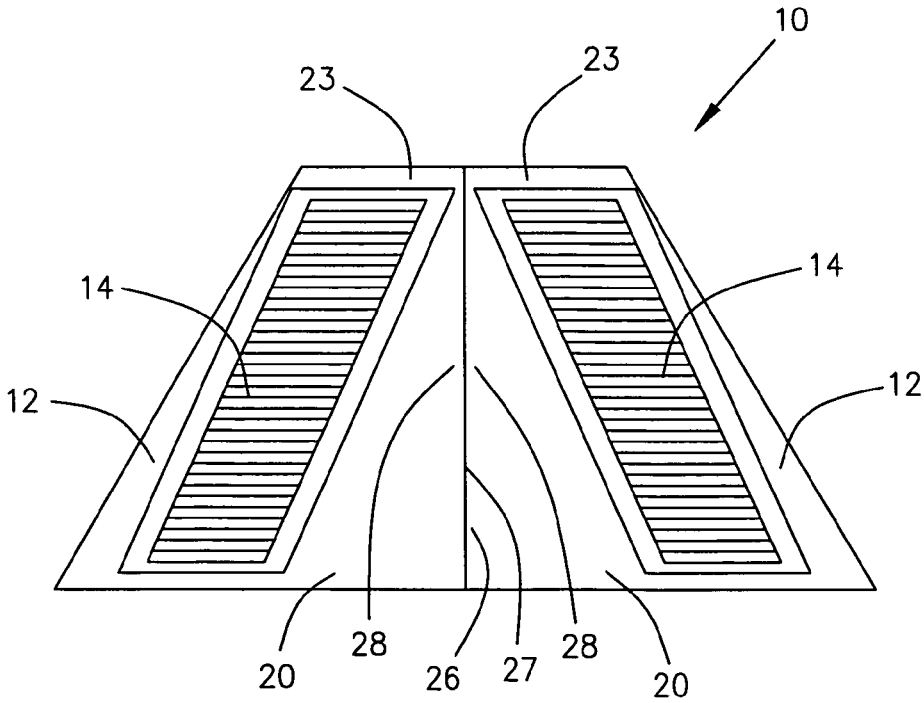
FIG. 5 is a front end view of the preferred embodiment taken along line 5-5 of FIG. 4.
Figure 4A:
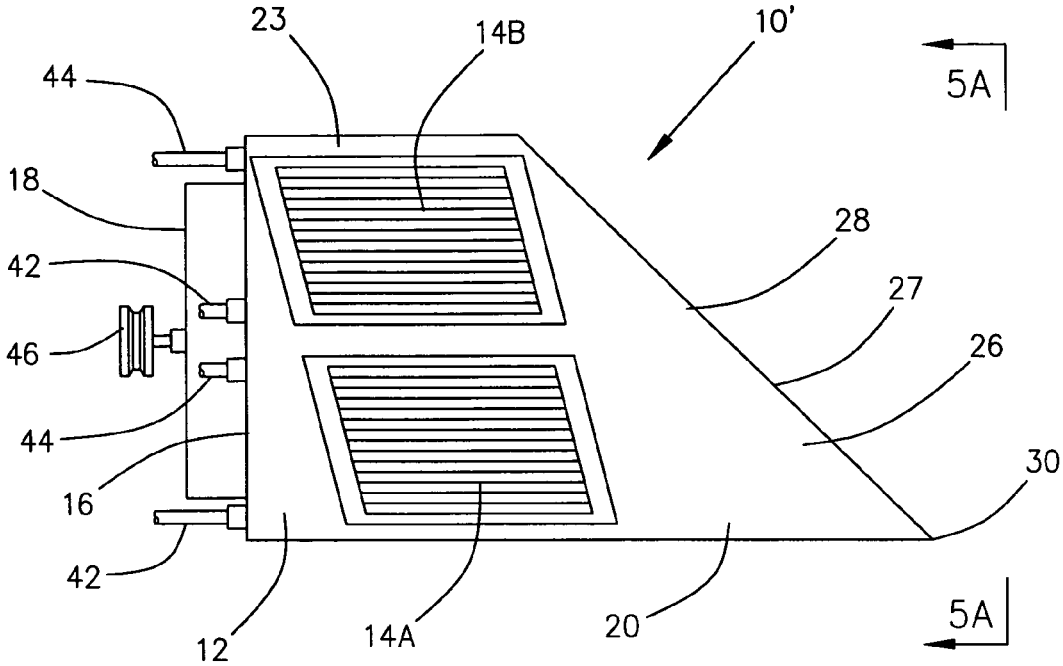
FIG. 4A is a right side view of the first alternate embodiment taken along line 4A-4A of FIG. 2A.
Figure 5A:
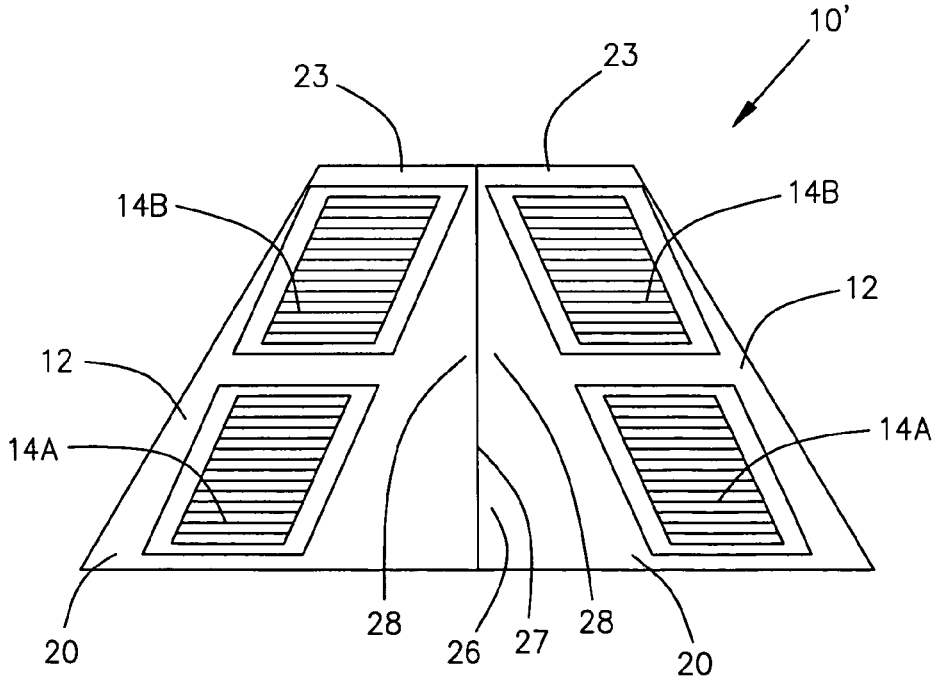
FIG. 5A is a front end view of the first alternate embodiment taken along line 5A-5A of FIG. 4A.

Referring now to FIGS. 2A, 3A, 4A and 5A, there is illustrated a first alternate embodiment 10' of the present invention. As previously illustrated in association with the preferred embodiment 10 illustrated in FIGS. 1-6, each heat exchanger coil wall 12 can be provided with one coil 14 per heat exchanger coil wall or, as illustrated in FIGS. 2A, 3A, 4A, and 5A in association with the first alternate embodiment 10', one or both of the heat exchanger coil walls 12 can be provided with multiple coils 14A, 14B, etc. so that each of the individual coils 14A, 14B, etc. that can provide heat exchanger capability to separate and varied applications (not illustrated). Also, as illustrated in FIG. 2A for heat exchanger 10', an optional top heat exchanger coil 14T can be added to a modified top 24'. Although not illustrated for heat exchanger 10 and 10", this modified top 24' and optional top heat exchanger coil 14T can be provided on the heat exchanger 10, 10' or 10" to provide added heat exchange capacity.

As illustrated for both the preferred embodiment 10 and the first alternate embodiment 10', the front or nose 26 of the heat exchanger 10 or 10' normally forms a pointed and downwardly sloping end 27 where the two sloping front edges 28 of the heat exchanger coil walls 12 meet at the front 30 of the heat exchanger 10 or 10'. In these embodiments 10 and 10', this sloping front end 27 extends downward and secures to a front point 32 of the triangular shaped base 22 of the heat exchanger 10 or 10'. This arrangement works well for forced draft heat exchangers where the heat exchanger fan 18 is pushing air through the inside of the heat exchanger plenum and then out of the heat exchanger 10 or 10' through the coils 14. This arrangement works well in the forced draft heat exchangers 10 and 10' because any air from the fan 18 that does not pass through the coils 14 and thus bounces off of the coils 14 back into the inside of the plenum is deflected to the pointed nose 26 and thus does not create back pressure on the fan 18.

Figure 9:
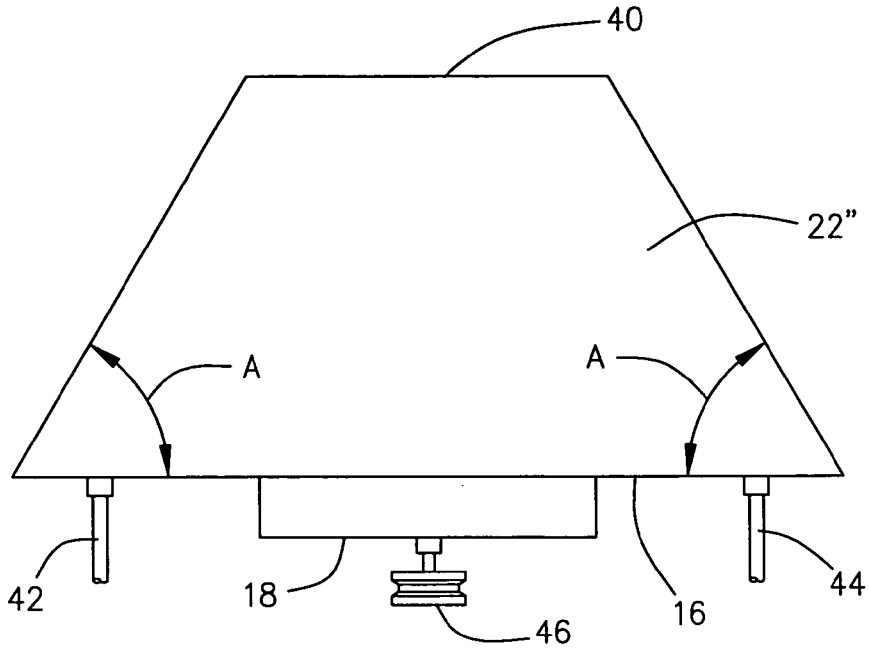
FIG. 9 is a bottom plan view of the second alternate embodiment taken along line 9-9 of FIG. 8.
Figure 7:
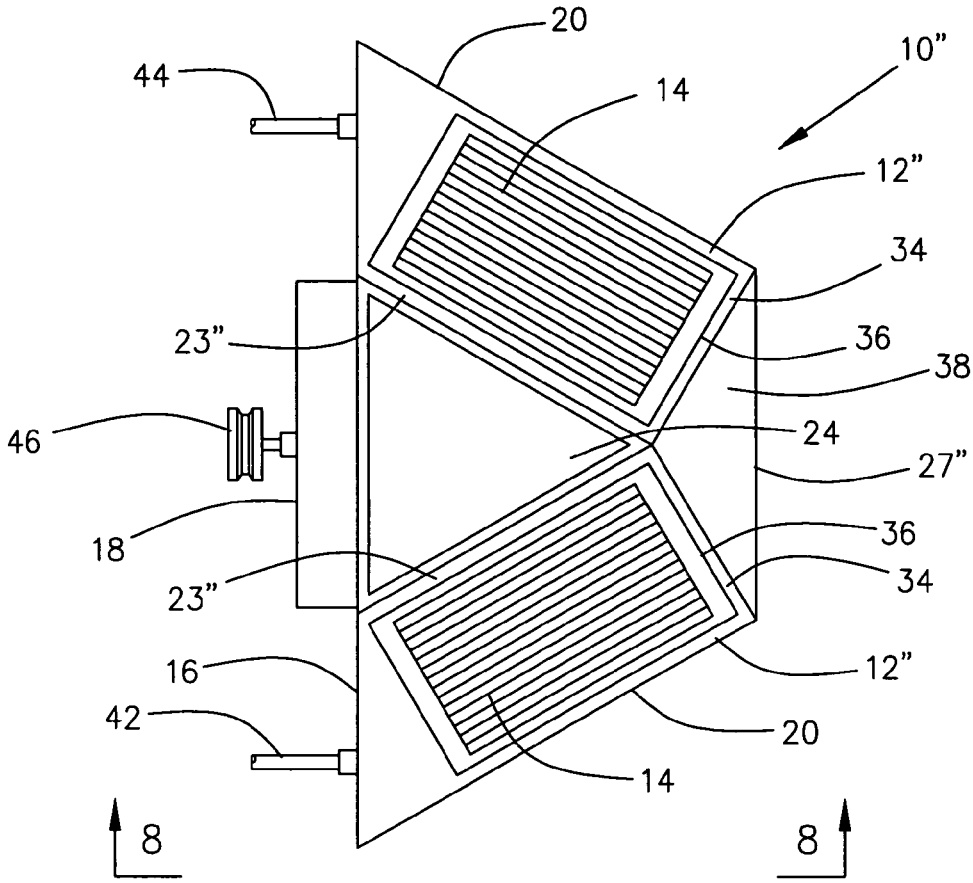
FIG. 7 is a top plan view of a second alternate embodiment which employs an induced draft fan and a modified front end.
Figure 8:
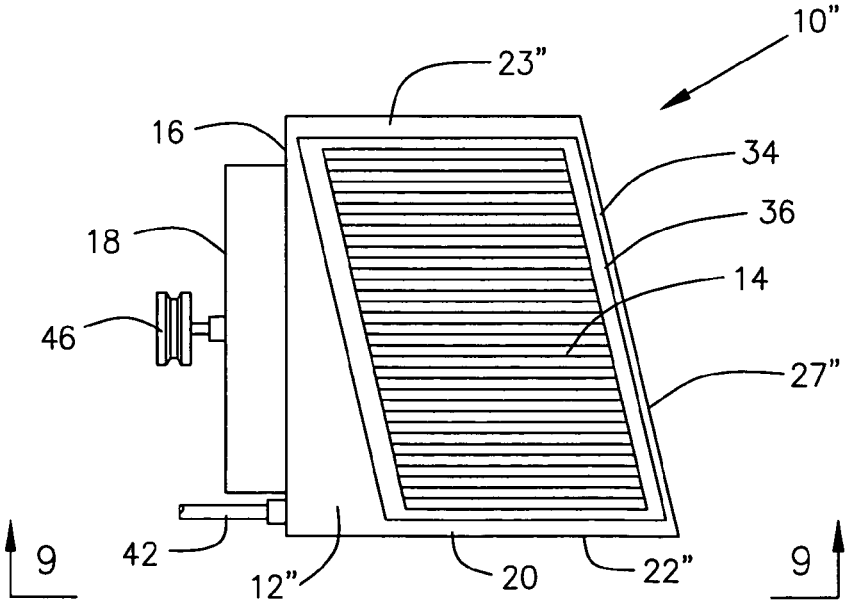
FIG. 8 is a right side view of the second alternate embodiment taken along line 8-8 of FIG. 7.

However, on an induced draft heat exchanger 10" where the heat exchanger fan 18 is pulling air through the coils 14, then through the inside of the plenum and finally out of the heat exchanger 10" through the fan 18, the front end 27" of the heat exchanger 10" does not need to be pointed. As illustrated in FIGS. 7, 8 and 9 for a second alternate embodiment 10" of the present invention, the induced draft heat exchanger 10" of the present invention employs modified heat exchanger coil walls 12" that are terminated at the front edge 36 of the heat exchanger coils 14 to form front edges 34 on each modified wall 12". A triangular shaped front plate 38 is secured to the front edges 34 of the shortened modified heat exchanger coil walls 12" and the front edge 40 of a modified base 22" of the second alternate embodiment heat exchanger 10". The modified base 22" of this induced draft unit 10" is trapezoidal shaped. Top edges 23" of the modified heat exchanger coil walls 12" attached to the top 24. Together the rear wall 16 and its associated fan 18, the modified base 22', the top 24, the front plate 38 and the two modified walls 12" cooperate to define an internal space or plenum area for the second alternate embodiment 10". By employing the shortened modified heat exchanger coil walls 12", the front plate 38, and the modified base 22", the foot print of the second alternate embodiment 10" is even smaller than the preferred embodiment 10 and the first alternate embodiment 10' of the present invention. Also, by eliminating the extra space in the plenum area, there is less chance for turbulence in the plenum area and thus the unit operates more quietly and more efficiently.

As illustrated in the figures, each heat exchanger coil 14, 14T, 14A, 14B, etc. is provided with coolant inlets and outlets 42 and 44 which move coolant to and from their associated coils 14, 14T, 14A, 14B, etc. Also, the fan 18 is generally provided with a fan pulley 46 by which the fan 18 is turned by motive means (not illustrated) such as a motor.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A triangular shaped heat exchanger comprising:

two heat exchanger coil walls attached to a heat exchanger fan at double and non-perpendicular angles with respect to the heat exchanger fan, each heat exchanger coil wall provided with at least one heat exchanger coil, a triangular top attached to the fan and to top edges of the two heat exchanger coil walls, a base attached to the fan and to bottom edges of the two heat exchanger coil walls so as to cooperate with the top and walls to form an internal plenum area of a triangular shaped heat exchanger, each heat exchanger coil wall oriented at an angle of between approximately 35 and 85 degrees to the fan, and each heat exchanger coil wall tilted inward toward its associated heat exchanger coil wall at an angle of between approximately 35 and 85 degrees relative to the base, each heat exchanger coil wall modified by shortening it so that each modified wall attaches by its front edge to a triangular shaped front plate, and the base being modified to be trapezoidal shaped, and the triangular shaped front plate securing to the front edge of the modified trapezoidal shaped base.

2. A triangular shaped heat exchanger comprising:

two heat exchanger coil walls attached to a heat exchanger fan at double and non-perpendicular angles with respect to the heat exchanger fan, each heat exchanger coil wall provided with at least one heat exchanger coil, a triangular top attached to the fan and to top edges of the two heat exchanger coil walls, a base attached to the fan and to bottom edges of the two heat exchanger coil walls so as to cooperate with the top and walls to form an internal plenum area of a triangular shaped heat exchanger, each heat exchanger coil wall modified by shortening it so that each modified wall attaches by its front edge to a triangular shaped front plate, and the base being modified to be trapezoidal shaped, and the triangular shaped front plate securing to the front edge of the modified trapezoidal shaped base.

* * * * *